US010998621B1

(12) United States Patent
Judd

(10) Patent No.: US 10,998,621 B1
(45) Date of Patent: May 4, 2021

(54) WIDEBAND DUAL POLARIZED ANTENNA ARRAY SYSTEM

(71) Applicant: Mano D. Judd, Heath, TX (US)

(72) Inventor: Mano D. Judd, Heath, TX (US)

( * ) Notice: Subject to any disclaimer, the term of this patent is extended or adjusted under 35 U.S.C. 154(b) by 28 days.

(21) Appl. No.: 16/689,278

(22) Filed: Nov. 20, 2019

(51) Int. Cl.
*H01Q 1/52* (2006.01)
*H01Q 1/38* (2006.01)
*H01Q 1/24* (2006.01)

(52) U.S. Cl.
CPC ..... *H01Q 1/523* (2013.01); *H01Q 1/246* (2013.01); *H01Q 1/38* (2013.01)

(58) Field of Classification Search
CPC ..... H01Q 1/523; H01Q 1/38; H01Q 1/246
See application file for complete search history.

(56) References Cited

U.S. PATENT DOCUMENTS

| | | | | |
|---|---|---|---|---|
| 9,142,889 | B2 * | 9/2015 | Pazin | H01P 5/028 |
| 10,665,950 | B2 * | 5/2020 | Yonei | H01Q 13/16 |
| 10,833,745 | B2 * | 11/2020 | Chen | H01Q 21/0075 |
| 10,897,090 | B2 * | 1/2021 | Navarro | H01Q 1/288 |

* cited by examiner

*Primary Examiner* — Brian K Young

(57) ABSTRACT

A wideband dual polarized antenna array system, with minimal number of RF ports that enables wideband array frequency ratios of 25:1 to 120:1. Reduced grating lobe performance is enabled by employing antennas-within-antennas. Orientation and spacing of antennas in novel methodologies further reduces sidelobes and grating lobes. Finally, this technology reduces the number of RF ports, compared to Tightly Coupled Dipole Antenna (TCDA) arrays by 10× to 25× times.

16 Claims, 24 Drawing Sheets

$$d < \frac{\lambda}{1 + |\sin\theta|}$$

| θ | Minimum d |
|---|---|
| 0° | 1 λ |
| 30° | 0.66 λ |
| 45° | 0.59 λ |
| 60° | 0.54 λ |
| 90° | 0.50 λ |

| Antenna Phase Center | Frequency Coverage |
|---|---|
| ● | $f_1$ – $5f_1$ |
| ○ | $4f_1$ – $20f_1$ |
| ◍ | $6f_1$ – $30f_1$ |
| ⊜ | $12f_1$ – $60f_1$ |

| Antenna Phase Center | Frequency Coverage |
|---|---|
| ● | $f_1$ – $5f_1$ |
| ○ | $4f_1$ – $20f_1$ |
| ◍ | $6f_1$ – $30f_1$ |
| ⊜ | $12f_1$ – $60f_1$ |

| Antenna Number | Antenna Phase Center | Frequency Coverage |
|---|---|---|
| 01 | ● | $f_1$ – $5f_1$ |
| 02 | ○ | $4f_1$ – $20f_1$ |
| 03 | ◍ | $6f_1$ – $30f_1$ |

| Antenna Number | Antenna Phase Center | Frequency Coverage |
|---|---|---|
| 01 | ● | $f_1$ – $5f_1$ |
| 02 | ○ | $4f_1$ – $20f_1$ |
| 03 | ✚ ◍ | $6f_1$ – $30f_1$ |
| 04 | ⊜ | $12f_1$ – $60f_1$ |

Note, we also can add a reduced size stand off antenna, at the center of (1), to extend the frequency range of (1).

| Antenna Number | Antenna Phase Center | Frequency Coverage |
|---|---|---|
| 01 | ● | $f_1$ – $5f_1$ |
| 02 | ○ | $4f_1$ – $20f_1$ |
| 03 | ✚ ◍ | $6f_1$ – $30f_1$ |

| Antenna Number | Antenna Phase Center | Frequency Coverage |
|---|---|---|
| 01 | ● | $f_1$ – $5f_1$ |
| 02 | ○ | $4f_1$ – $20f_1$ |
| 03 | ✚ ◍ | $6f_1$ – $30f_1$ |

| Antenna Number | Antenna Phase Center | Frequency Coverage |
|---|---|---|
| 01 | ● | $f_1$ – $5f_1$ |
| 02 | ○ | $4f_1$ – $20f_1$ |
| 03 | ✚ ◍ | $6f_1$ – $30f_1$ |
| 04 | ⊜ | $12f_1$ – $60f_1$ |

| Antenna Number | Antenna Phase Center | Frequency Coverage |
|---|---|---|
| 01 | ● | $f_1$ – $5f_1$ |
| 02 | ○ | $4f_1$ – $20f_1$ |
| 03 | ✚ ◍ | $6f_1$ – $30f_1$ |
| 04 | ⊜ | $12f_1$ – $60f_1$ |
| 05 | ⊘ | $24f_1$ – $120f_1$ |

| Antenna Number | Antenna Phase Center | Frequency Coverage |
|---|---|---|
| 01 | ● | $f_1$ – $5f_1$ |
| 02 | ○ | $4f_1$ – $20f_1$ |
| 03 | ✚ ◍ | $6f_1$ – $30f_1$ |
| 04 | ⊜ | $12f_1$ – $60f_1$ |

Front View

Top View

WIDEBAND DUAL POLARIZED ANTENNA ARRAY SYSTEM

The present application claims priority to the earlier filed provisional application having Ser. No. 62/789,358, and hereby incorporates subject matter of the provisional application in its entirety.

BACKGROUND

Prior to attempting to define the array/bandwidth/gain problem or limitation, it is prudent to define a common metric to describe and/or characterize antenna array bandwidth and performance, to a useful system metric. There are many sources in the literature that describe antenna element functional bandwidth, usually in either impedance bandwidth, gain bandwidth, or some other bandwidth metric. Often, many of the antenna (element) characteristics are extended to the array characteristics, since most phased array systems utilize a single common antenna type, used throughout the array. For example, there are many wideband antenna elements or antenna technologies that claim impedance bandwidth performance up to a 10:1 frequency ratio, or greater. This bandwidth component, that is impedance bandwidth, is only one term in the three term expansion, or for the three product terms for antenna Absolute Gain. These three terms are Matching Efficiency, Radiation Efficiency, and Directivity. The product of these three terms gives the resultant Antenna Absolute Gain, as a function of frequency, and azimuth, and elevation (directions). Therefore, impedance bandwidth, which only describes the antenna matching efficiency, is a relatively incomplete characterization of any antenna and especially an array of antennas. Additionally, an antenna with huge impedance bandwidth, could have very low radiation resistance across its full impedance bandwidth as well as having very large ohmic resistance across this same bandwidth, such that the sum of the radiation resistance and the ohmic resistance is equal to the transmission line resistance or impedance (for example: 50 ohms). In this case, the antenna would have very good matching efficiency, but very low radiation efficiency, and thus be considered a poor antenna. An array of such antennas, would thus have very large impedance bandwidth, but have very low array bandwidth and efficiency. (Example: https://www.mobilemark.com/faqs/how-do-you-specify-the-bandwidth-of-an-antenna/)

A much better metric to use is Gain Bandwidth. The Gain Bandwidth of an antenna takes into account all three components of Absolute Gain, and not simply the impedance bandwidth. However, even the use of Gain Bandwidth has been distorted in many sources and texts. The greater perpetrators here use "Peak" Antenna Gain to specify the operating range of their antenna. However, for example, for a dipole antenna of major axis length of a half-wavelength, operation of this antenna past 1 to 1.5 wavelengths produces a split in the E-Field Pattern, where the maximum Gain (Peak Gain) is no longer in the direction broadside (or boresight) to the major axis of the physical antenna, but changes elevation value (phi angle) as the antenna frequency increases. This characteristic is similar for Vivaldi antennas, as well as many other antenna types, commonly used in antenna arrays. Therefore, the best overall performance metric for describing the bandwidth of an antenna is Gain Bandwidth, such that the maximum Gain is always in the Broadside (or boresight) direction.

Additionally, in terms of Impedance Bandwidth and Gain Bandwidth, what should be the minimum VSWR or Return Loss acceptable across the operating range of the antenna and the resulting array, as well as the minimal acceptable Broadside Gain Bandwidth? IEEE sets this to a VSWR of 2:1, which is a Return Loss (RL) of −10 dB. However, will an antenna operate below a VSWR of 2:1? Of course it will. Most transmitter systems follow the exciter with an RF Power Amplifier (RFPA), and most RFPA manufacturers specify that the worst VSWR, from the PA looking into the antenna (port) should be no worse than a 3:1 VSWR, or equivalently a −6 dB Return Loss. What is the difference between a 2:1 VSWR and a 3:1 VSWR (or a RL of −10 dB and −6 dB) in terms of throughput loss? This only 1 dB of loss! A 1 dB loss in most systems is not considered catastrophic. While academics usually assign an acceptable antenna VSWR of 2:1 across the operating band, most systems design engineers easily accept a 3:1 VSWR (RL of −6 dB) for antenna performance.

Finally, what would be the minimal Broadside directed Antenna Gain. This actually is a relative value which depends on the application, with no real definitive value. However, with 1 dB of Throughput Loss, due to reduced antenna VSWR, and with a few ohms of Ohmic Resistance (present in any real antenna), it is safe to say that achieving an Antenna Broadside Gain of +0 dBi is likely considered to be a very good omni-directional antenna. With a reflector, this would be raised to +3 dBi.

Therefore, we finally have a good metric for antenna performance, to be applied to our array, to help specify the array performance. Good Antenna Bandwidth is specified as:

Absolute Gain, in the Broadside Direction, equal to or better than +0 dBi across the full operation frequency range of the antenna.

An absolute worst of 3:1 VSWR at the antenna feed (or equivalently an antenna RL of −6 dB), with a desired VSWR of 2:1 (RL of −10 dB) throughout.

Now that we have a reasonable definition of a good antenna (element), we can address desired attributes of an antenna array. A highly desired antenna array system would have the following characteristics:

- Greatest operational frequency range, or frequency ratio, measure in Broadside Gain Bandwidth for all antennas within the array
- All array antennas (elements), within the array, have a VSWR no worse than 3:1 (RL of −6 dB) across the full operational range of the full Gain Bandwidth
- Fully dual or diversely polarized, at each and every element, so that the array can transmit or receive signals in any polarization. This capability would be most utilized in fully digital arrays, where element pairs (in diverse or orthogonal polarization) can be easily [digitally] quadrature summed to exploit any incident or transmitted signal polarization.

High array scanning volume. This metric depends on the application, however, as a minimum we would want +/−45 degree scan volume.

Vivaldi antennas, while having up to 12:1 Impedance Bandwidth, actually only have Broadside Gain Bandwidth of 4:1, or an upper maximum of 6:1 as claimed in some technical papers. A major implementation issue with Vivaldi antennas is their deep lengths, consuming multiple wavelengths at the lowest frequency of operation.

Interleaving Vivaldi structures, horn antennas, or even dipole antennas, to achieve a wideband antenna array, has been found to have many significant performance issues. One of these is that above 3:1 operating bandwidth (Gain Bandwidth), that the un-suppressed grating lobes become significantly large. There are means to suppress grating lobes, after digitization of the signal, such as Taylor Filtering, however these methods tend to reduce the main beam power (amplitude) or widen the main beam. The best results have been found with single polarization antenna and array systems. However, when attempting to design a dual or diversely polarized antenna array system, most sources have only been able to achieve a 2:1 or maximum 3:1 ratio operation frequency range.

A recent innovation in array design is the Tightly Coupled Array (TCA) or Tightly Coupled Dipole Array (TCDA) technology. This has witnessed significant development and innovations since 2008, and has produced wideband arrays with measured bandwidths up to 20:1. Implementation of these arrays have found shown that many actual designed systems have significantly reduced Absolute Broadside Gain at the lower operational frequencies, with as much as 5 to 15 dB of loss in many systems. However, one of the worst problems with this technology is the number of RF ports required, per Low Frequency Cell (LFC). This (LFC) is the minimum size of a structure (cell) that generates a single full antenna that operates, with Broadside Absolute Gain of greater than +0 dBi, at the lowest operational frequency of the array. For a 25:1 bandwidth TCDA system, will require roughly 25×25=625 distinct RF ports simply for a single polarized LFC. This becomes 1250 RF ports for dual polarization LFC. For an array of 16 such LFC's, which enables an array of 4×4 LFC elements, this would require 20,000 RF ports. This becomes extremely expensive as a function of array bandwidth, and requires very high SWAP (Size, Weight, and Power).

Therefore, the ideal Wideband Dual Polarized Antenna Array solution would have the following characteristics:

Array operation bandwidth, with broadside gain above +0 dBi, over a 4:1 ratio bandwidth or greater.

Zero to low RF grating lobes, across the full operational bandwidth, prior to any digital grating lobe filtering or grating lobe suppression techniques.

Far less RF ports (at least an order of magnitude less) than the TCDA solution.

BRIEF SUMMARY OF THE INVENTION

A wideband dual polarized antenna array system, with minimal number of RF ports, which enables wideband array frequency ratios of 25:1 to 100:1.

Innovation(s):

Use of author's previous US Patents (pending), including:

a) Dual Polarized Wideband Dipole Antenna patent (U.S. Pat. No. 10,389,015)

b) Compact Wideband Slot Antenna patent (U.S. patent application Ser. No. 16/582,061)

b) Decoupled Inner Slot Antenna patent (US patent application Ser. No. 16/663,650)

Combining these three technologies enables the Wideband Array.

This array contains antennas within antennas. This enables not only higher compactness of the array, but as the array operating frequency increases, the antennas between already activated antennas can be activated to achieve lower antenna-to-antenna spacing distance(s) and to avoid the generation of grating lobes.

The arrangement and spacing of antennas in this novel methodology(s) further reduces greater lobes, as the [Wideband System] frequency of operation is increased. Interleaved and antenna-within-antennas are activated to assure zero to minimal grating lobes and sidelobes.

Benefits Include:

a) 25:1 to 100:1 ratio operational frequency range b) Reduced number of RF ports, compared to Tightly Coupled Dipole Antenna (TCDA) arrays by 10× to 25× times.

c) Can be implemented on a flat or conformal surface.

d) operational on a single layer of copper (metal).

e) operational on curved surfaces, like aircraft wing leading edges.

Array Function and Performance Goals

Nearly infinite operational frequency (array operating bandwidth).

No Grating Lobes at any frequency, within the operational array bandwidth.

The ability to transmit or receive dual or diversely polarized signals, at any frequency within the operational bandwidth.

Simple to construct, with low fabrication costs. This would include single or dual layer antennas.

The back-end (RF ports) easily plumbs to existing or almost-COTS RF and Digital hardware. This includes the most minimal number of RF ports, per unit frequency.

Minimum Scan Volume of +/−45 degrees, in both axis (azimuth and elevation).

DETAILED DESCRIPTION AND BEST MODE OF IMPLEMENTATION

Figure 1:
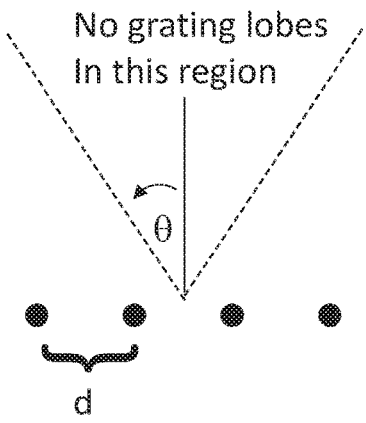
FIG. 1 shows the condition for minimum RF grating lobes.

FIG. 1 shows the condition for minimum RF grating lobes. The value d is the separation distance between antenna phase centers, θ is the carrier signal wavelength, and λ is the angle off array broadside (or boresight). For signals incident to exact broadside (or boresight), the minimum element spacing in the array to achieve no grating lobes would be one wavelength or less. For desired operation fully to 90 degrees (off broadside or boresight) requires that maximum antenna element spacing be equal to or less than a half-wavelength. However, for many arrays, the antenna element gain performance falls off dramatically as the incident angle tends to 90 degrees. For many applications of linear arrays, where a second array would be oriented perpendicular to the first array, then each array would only need to cover a 90 degree sector (in azimuth), or +/−45 degrees. It is of course desired to enable the greatest amount of Scan angle or Scan volume as practical, however, at some point, either a circular set of antennas must be used or a second (and perhaps third) linear array be used to cover ultra-wide sectors. Therefore, for the +/−45 degree applications, we can see that element spacing up to 0.59 wavelengths will product zero net grating lobes. For practical purposes, this will be rounded out to 0.6 wavelengths.

Figure 2:
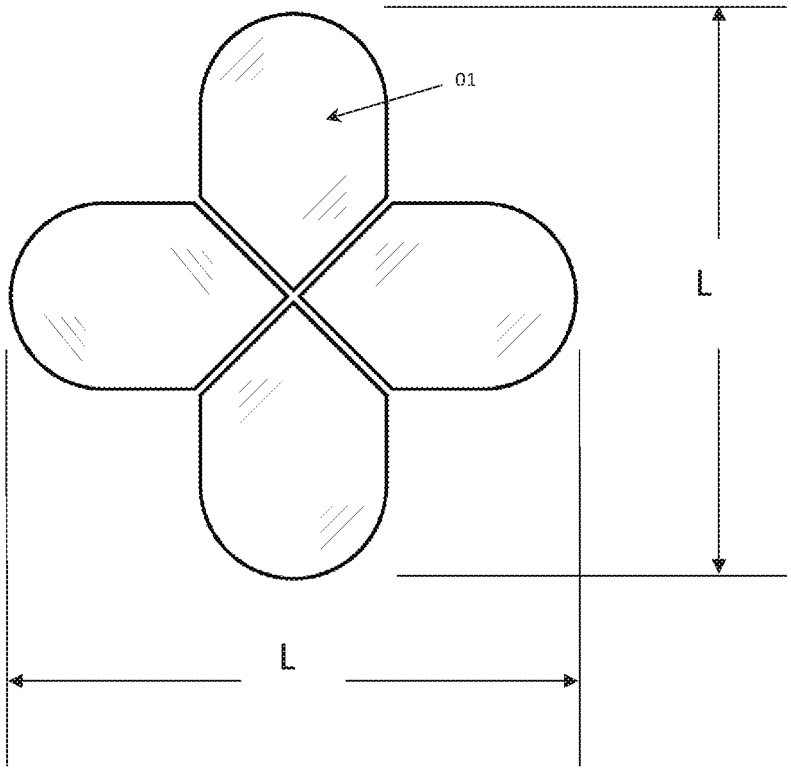
FIG. 2 illustrates a Wideband Dual Polarized antenna.

FIG. 2 shows a Wideband Dual Polarized antenna. This antenna type is US Patent Pending by Mano Judd (application Ser. No. 15/210,583). It consists of two orthogonal Wideband antennas, each polarized subset wideband antenna characterized by two opposite dipole legs, and designated as the 01 antenna element. Both dual orthogonal dipole feeds are at the center of the antenna structures, and are symmetric to one another. Both orthogonal dipoles can be operated at the same frequency simultaneously, due to strong isolation (high S12) from one another. The length of each orthogonal dipole, L, is roughly 0.3*λ1 where λ1 is the wavelength at the lowest transmit frequency of operation, $f_1$. At this lowest frequency of operation, the measured Return Loss (RL) of each cross element (dipole) is better than −6 dB (a VSWR better than 3:1) and the measured antenna Broadside Absolute Gain is better than +0 dBi. As the frequency slightly increases, the [measured] RL improves to −10 dB throughout operation to $5*f_1$ or $f_5$, and the [measured] Absolute Broadside increases or at least stays above +0 dBi. Therefore, this cross dipole antenna system has a verified [measured] operational bandwidth of 5:1, in which the Absolute Broadside Gain is better than +0 dBi and the RL is better than −6 dB (−10 dB over 95% of the operational band). Below the $f_1$ frequency, that this antenna system also has Absolute Broadside Gain better than −3 dBi at 0.25 λ1, which would be equivalent to $(0.25/0.3)*f_1=0.833\ f_1$. Therefore, there is still very adequate performance for this antenna system to frequencies below $f_1$, for most antenna and array applications.

Figure 3:
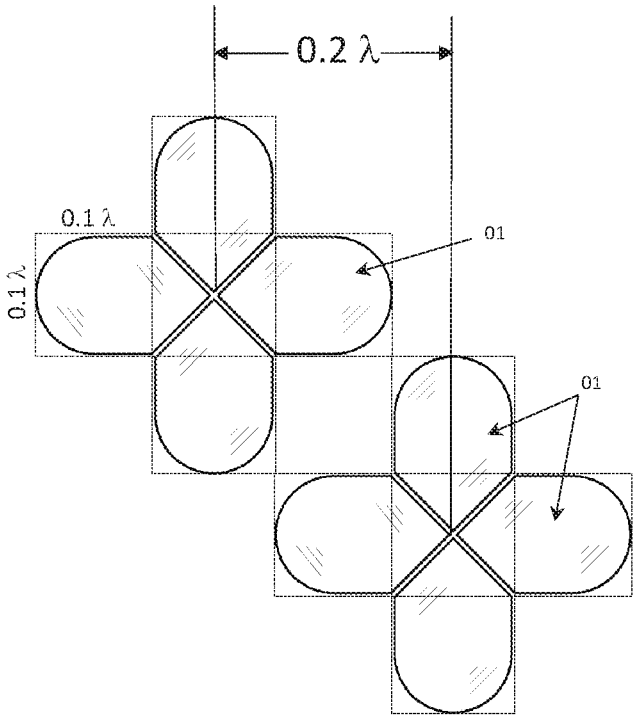
FIG. 3 presents a two Dual Polarization Antenna subset or two 01 antennas, in the desired configuration and orientation.

FIG. 3 shows a two Dual Polarization Antenna subset or two 01 antennas, in the desired configuration and orientation. As shown, the two Dual Polarization Antennas (01) are offset to one another. This configuration, combined with these specific types of antennas is critical to the design, application, and embodiment of this invention for the purpose of achieving ultra-bandwidth capabilities.

Note, that for the Patent Pending Dual Polarization Wideband Antennas used, that the 01 antenna's lowest frequency of operation, $f_1$, indeed sets the minimum overall antenna size to L=0.3*λ1, where $\lambda 1=c/f_1$, and c=speed of light. With this prescribed antenna size, both antennas will have efficient radiation and Absolute Broadside Gain better than +0 dBi, over a frequency range of $f_1$ to $5*f_1$ or from $f_1$ to $f_5$. With these dimensions and specified displacement from one another and orientation, the phase center to phase center spacing between adjacent (neighboring) antennas is only 0.2 wavelengths, at the lowest frequency of operation, $f_1$. Therefore, for frequency of operation from $f_1$ to 3 times $f_1$, which will be denoted as $f_3$, this sub-array (Dual Polarization Antenna pair) will have no (natural or unsuppressed) RF grating lobes, within a +/−45 degree window, in both azimuth as well as elevation. This is since 3 times 0.2λ=0.6λ, which is the maximum antenna spacing to assure no grating lobes within +/−45 degrees broadside to the array. However, at frequency $f_3$ and above, RF grating lobes will begin to appear for this system.

Figure 4:
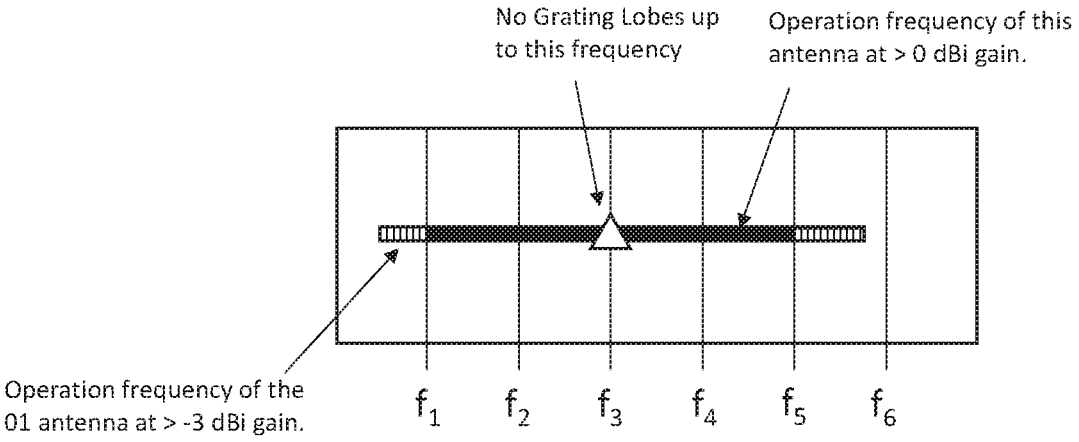
FIG. 4 shows the operational frequency range line chart for the subset array in FIG. 3, that of two (or more) Dual Polarized Wideband Antennas (01).

FIG. 4 shows the operational frequency range line chart for the subset array in FIG. 3, that of two (or more) Dual Polarized Wideband Antennas (01). The solid black portion of the bar shows the operational frequency range, with Absolute Broadside Gain better than +0 dBi. The white triangle shows the point as where grating lobes will start to occur, and grow, as frequencies increase. For frequencies below this triangular, there are no (natural or unsuppressed) RF grating lobes between +/−45 degrees from array broadside, all the way down to zero frequency. The stripped portions of the bar show where the Absolute Broadside Gain will be below +0 dBi, but above −3 dBi. It should be noted that for frequencies slightly above the triangle, grating lobes will only appear at angles close to +/45 degrees, and there will still be no grating lobes all the way through +/−35 degrees from array broadside.

Figure 5:
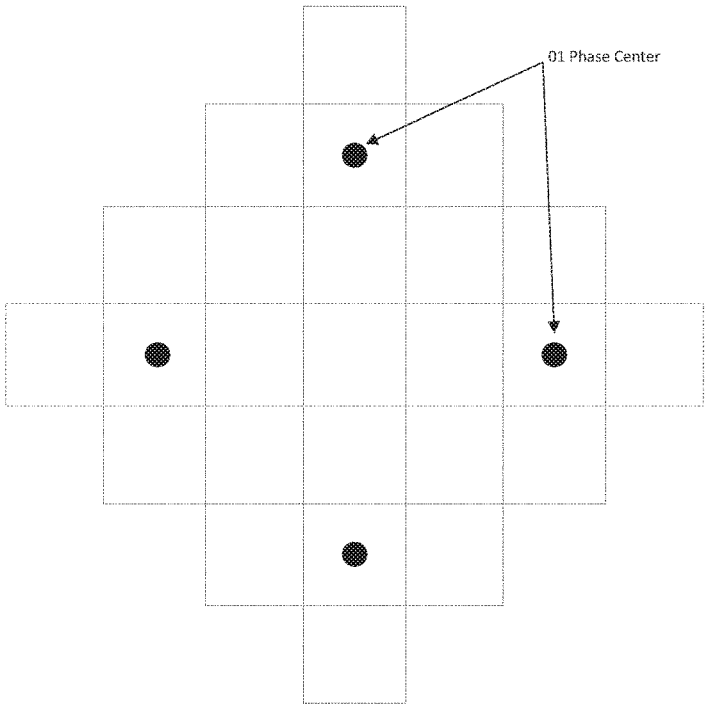
FIG. 5 illustrates the relative location of the phase centers for a 4-element array implementation of the 01 antennas from FIGS. 2 and 3.

FIG. 5 shows the relative location of the phase centers for a 4-element array implementation of the 01 antennas from FIGS. 2 and 3. In this diagram, only the largest antenna elements, with operational frequency coverage from f1 to $5*f_1$ (or from $f_1$ to $f_5$) are included.

Figure 6:
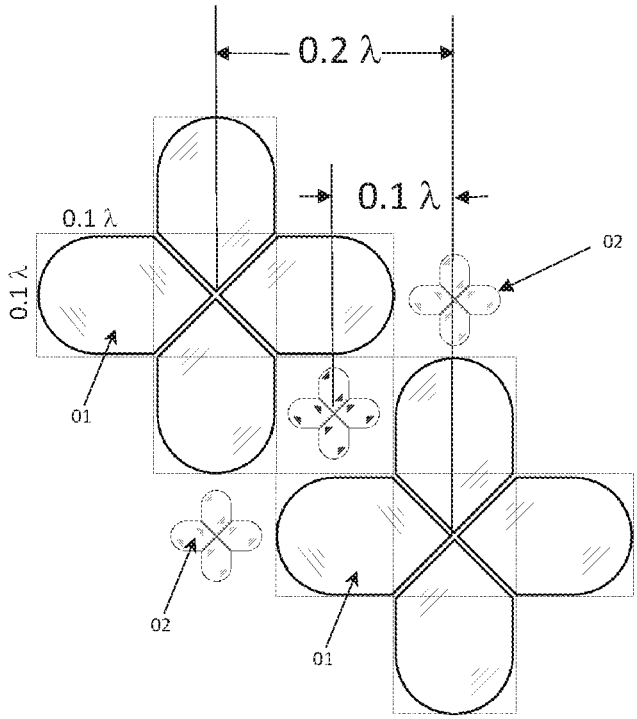
FIG. 6 presents the two 01 antennas, as well as antenna 02.

FIG. 6 shows the two 01 antennas, as well as antenna 02. The 02 antenna is simply a one-quarter scaled version of the 01 antenna, in every dimension. This scaling results in the 02 antenna operating, with Absolute Broadside Gain above +0 dBi, from $4*f_1$ to $20*f_1$ or denoted as $f_4$ though $f_{20}$. That is, from 4 times frequency $f_1$ through 20 times frequency $f_1$. FIG. 6 shows the relative positions and orientations of the 02 antenna, interleaved within the 01 elements in the same array. Measured results show that for the $f_4$ through $f_{20}$ frequencies, that the mutual coupling of these antennas either to each other (a 02 to a 02) or to the 01 antennas (a 02 to a 01) is less than −20 dB. Notice now, that the vertical or horizontal separation distance between any two antenna in the new interleaved array is now less than 0.1λ. This means that for the new interleaved array, that there will be no (natural or unsupressed) array grating lobes, for angles +/−45 degrees to array broadside, up to $6*f_1$ or $f_6$.

Recall from the chart in FIG. 4, that for use of only the 01 antennas and for frequencies slightly above the triangle, grating lobes will only appear at angles close to +145 degrees, and there will still be no grating lobes all the way through +/−35 degrees from array broadside. Additionally, Elements 02 will have gain slightly below +0 dBi, down to almost $f_3$. Therefore, even with slightly reduced gain, sufficient power can still be output from the 02 antennas near the $f_3$ frequency. Therefore, these two effects will combine and help to resist the formation of grating lobes between frequencies $f_3$ and $f_4$.

In FIG. 6, it can be seen that each 01 Antenna is comprised of two cross polarized wideband dipole antenna, from the Applicant's US Patent (pending) "Dual Polarization Antenna" application Ser. No. 15/210,583, each with size (or length) or 0.3*λ at the lowest frequency of operation, f1. It is further seen, in this embodiment, that each cross dipole is of size 0.1λ×0.3λ or that it is bounded by three unit cells of size 0.1λ×0.1λ. In this embodiment of the concept, all unit cells are of size 0.1λ×0.1λ. Further, the 02 full antenna fits within a single unit cell. Also notice that in this embodiment, that no antenna is physically touching or overlapping any other antenna.

Figure 7:
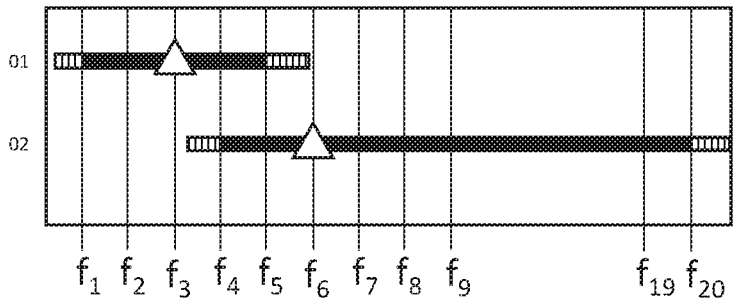
FIG. 7 shows the operational frequency range line chart for the subset array in FIG. 6, that of two (or more) Dual Polarized Wideband Antennas (01) and multiple scaled Dual Polarized Wideband Antennas (02).

FIG. 7 shows the operational frequency range line chart for the subset array in FIG. 6, that of two (or more) Dual Polarized Wideband Antennas (01) and multiple scaled Dual Polarized Wideband Antennas (02). Again the solid black portions of the bars shows the operational frequency range, with Absolute Broadside Gain better than +0 dBi, and the white triangles shows the point as where grating lobes will start to occur, and grow, as frequencies increase. When only the 01 antennas are "on" or used in the array, the triangle on the top bar will set the maximum frequency where there are no (natural or unsuppressed) RF grating lobes between +/−45 degrees from array broadside, all the way down to zero frequency. However, when all 01 antenna elements as well as 02 antenna elements are "on" or used in the array simultaneously, the bottom triangle will set the maximum no-grating-lobe frequency. In this case, $f_6$.

There are three further points to be made, with respect to array operation. Firstly, while the larger 01 antenna elements can operate, with greater than 0 dBi Gain all the way to frequency $f_5$, the smaller 02 antennas can operate all the way to $f_{20}$. Therefore, as the Absolute Gain of the 01 antennas falls off above frequency $f_5$, the 01 antennas will contribute less power to the array. However, the 02 antennas will be far more numerous. Thus, as the frequency further increases, there will some slight increases in sidelobes and perhaps grating lobes, and with some slight decrease in main beam gain or power. However, the array will still function. A potential solution to this issue will be address later. The second point to be made is there will still be plenty of operational bandwidth past $f_6$, all the way through to $f_{20}$. However, there will be the issue of ever growing (naturally or unsuppressed) sidelobes, ever growing in the +/−45 degree to broadside zones. The obvious solution to this is to employ a traditional sidelobe or grating lobe suppression technique, such as Taylor Windowing, for frequencies above $f_6$. This solution has been shown to work very well, with the trade-off of reduced main beam power (or gain) as well as possibly broadening the width of the main beam.

The third point to make is that for a system of four 01 antennas and fifteen 02 antennas, would require 19×2=38 RF ports for the whole array, with no grating lobes up to $f_6$ and digitally suppressed grating lobes up to $f_{20}$. A Tightly Coupled Dipole Array (TCDA) with the same four low frequency antennas, and covering a 6:1 bandwidth would require roughly 4×6×6×2=288 RF ports. A TCDA array covering a 20:1 bandwidth would require roughly 4×20×20×2=3200 RF ports. It is well known that TCDA arrays have many strong array characteristics, however, their implementation requires an enormous amount of back-end RF and Digital hardware. For the 6:1 coverage, the TCDA implementation requires 288/38=7.6 times as many RF ports, which amounts to 7.6 times the amount of RF back-end hardware (receiver or transceiver channels) and up to 57 times the processing hardware as the current invention. For the 20:1 coverage, the TCDA implementation requires 3200/38=84 times as many RF port which amounts to 84 times the amount of RF back-end hardware (receiver or transceiver channels) and up to 7056 times the processing hardware as the current invention. Therefore, the value in the current invention enables an extremely high reduction in Size, Weight, and Power (SWAP) as well as enormous cost savings.

Figure 8:
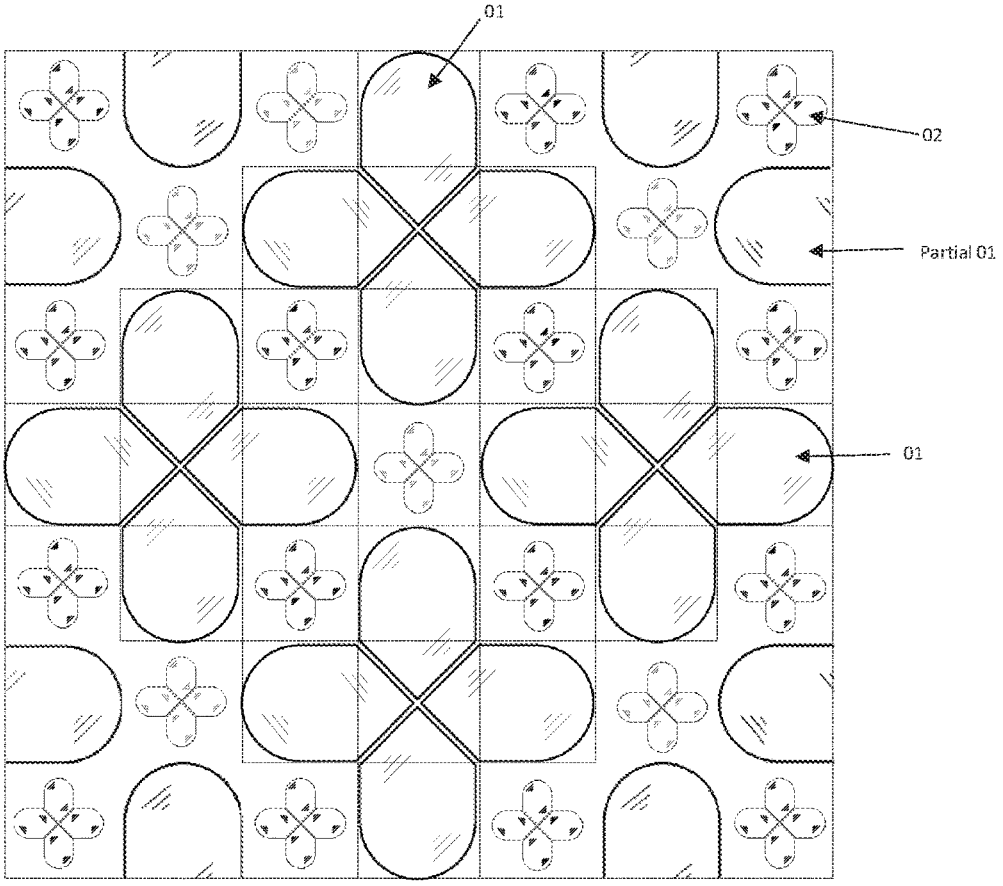
FIG. 8 illustrates a full implementation of the Dual Polarized Wideband Antenna array, including antenna elements 01, and 02, for one embodiment of the array concept.

FIG. 8 shows a full implementation of the Dual Polarized Wideband Antenna array, including antenna elements 01, and 02, for one embodiment of the array concept. This diagram in fact is actually showing a segment or cut-out of a dense array, including multiple partial arms of the 01 antennas on the borders. The cut-out, within this diagram, has 7×7 unit cells, with each unit cells of size 0.1λ×0.1λ. As can be seen, there are arm segments, of 01 antennas, from other full 01 antennas, not shown. This particular cut-out then has four full 01 antennas and 21 full 02 antennas, all interleaved. It can be seen, that as the frequency increases, so does the number of smaller 02 antennas. Furthermore, as in FIG. 3 the phase center to phase center spacing between adjacent (neighboring) 01 antennas is only 0.2 wavelengths, at the lowest frequency of operation, $f_1$. Therefore, for frequency of operation from $f_1$ to 3 times $f_1$ (denoted as $f_3$), this full array will have no (natural or unsuppressed) RF grating lobes, within a +/−45 degree window, in both azimuth as well as elevation. Furthermore, with the addition of the 02 antennas, the phase center to phase center spacing between any two adjacent (neighboring) 01 or 02 antennas is only 0.1 wavelengths, at the lowest frequency of operation, $f_1$. Therefore, for frequency of operation from $f_1$ to 6 times $f_1$ (denoted as $f_6$), this full array will have no (natural or unsuppressed) RF grating lobes, within a +/−45 degree window, in both azimuth as well as elevation.

It should be mentioned at this point, that the implementation of this array concept as of yet does not include a reflector, backside ground plane, cavity backing, or lossy media. That is, at this point, the planar array is completely two-sided, with equal radiation pattern and gain on two sides. There are numerous applications, where a two-sided array is desired. However, for cases where a one-sided array is desired, there are numerous mechanisms that can be used to enable Wideband One-Sided performance. The simplest solution is using a lossy backing that absorbs or suppresses the back lobe. However, this will have roughly one-half (−3 dB) the power for the One-Sided main beam, as a system that exploits a reflective wave, from a backside reflector. A current technology that could be used for a wideband reflector is the use for Frequency Selective Surfaces (FSS).

There are many designs of FSS that could be used to enable One-Sided performance, depending on the characteristics desired. There is no loss of generality, where the current concept can be employed on any of these backside (lossy or reflective) solutions.

Figure 9:
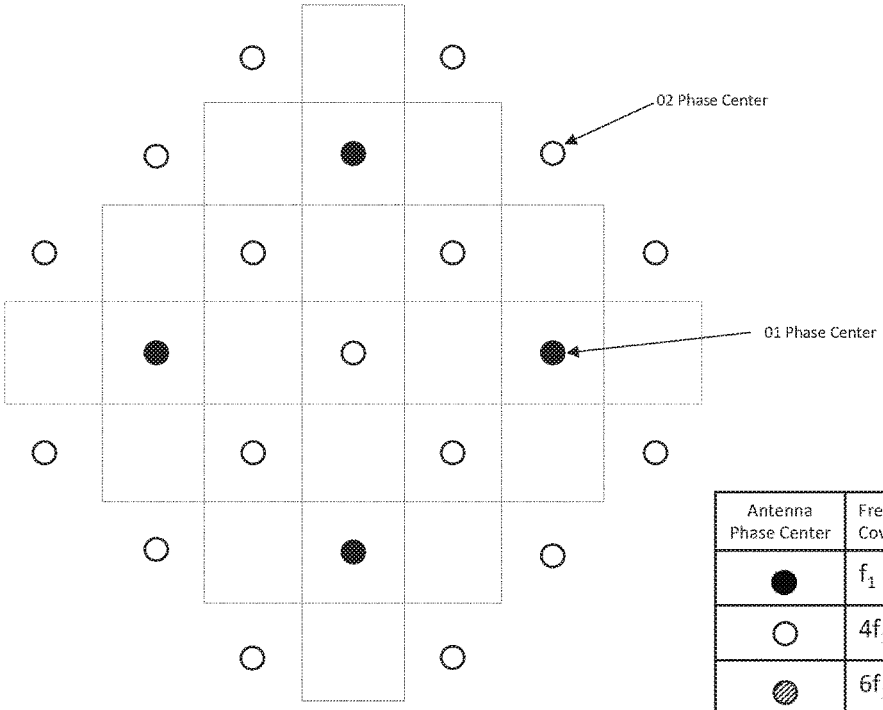
FIG. 9 shows the relative location of the phase centers for a 4-element array implementation of the 01 antennas and 17 of the 02 antennas.

FIG. 9 shows the relative location of the phase centers for a 4-element array implementation of the 01 antennas and 17 of the 02 antennas. The 02 antennas are interleaved exactly in between (half the distance) from the phase centers of the 01 antennas. This therefore represents a Radix-2 (power of 2) interleaving methodology. The legend on the top left shows the frequency coverage for each sub-array. The first sub-array is composed of 01 antennas, and therefore covers the frequency range of $f_1$ to $f_5$. The second sub-array is composed of 02 antennas, and covers the frequency range of 4 times $f_1$ to 20 times $f_1$ (or $f_4$ to $f_{20}$).

Figure 10:
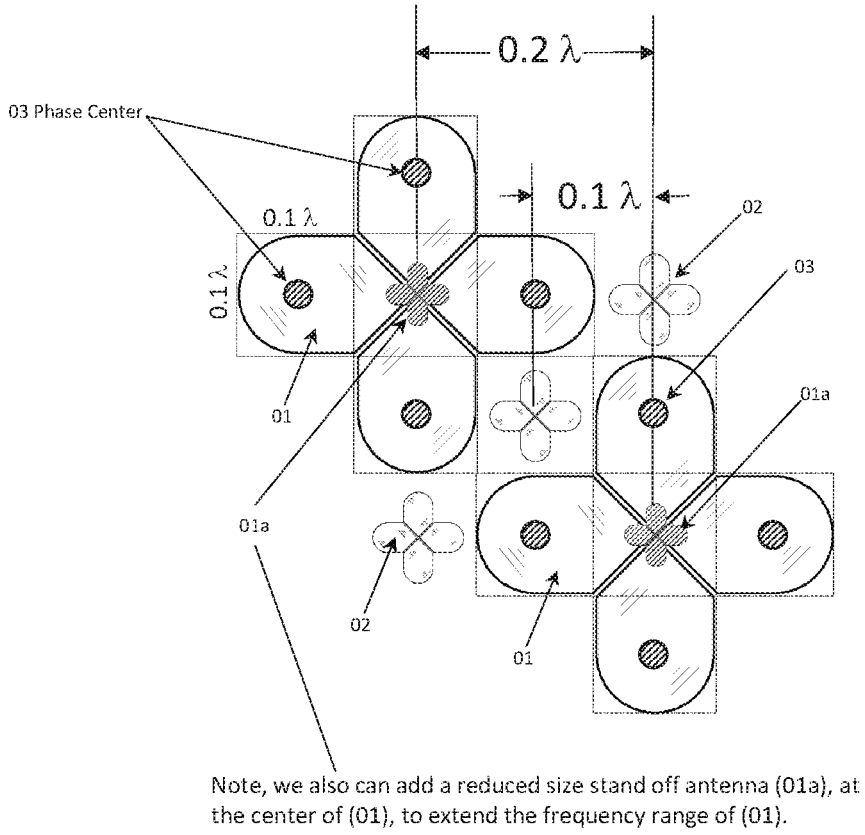
FIG. 10 illustrates the same arrangement of 01 and 02 antennas as FIG. 6, but now includes the addition of Wideband Compact Slot Antennas.

FIG. 10 shows the same arrangement of 01 and 02 antennas as FIG. 6, but now includes the addition of Wideband Compact Slot Antennas. These antenna, e.g. Wideband Compact Dual-Polarized Slot Antennas are covered in the Applicant's "Compact Wideband Slot Antenna with Inverted Co-Planar Waveguide" U.S. patent No. 62/744,995 and the use as Antennas-within-Antennas is covered in the Applicant's "Decoupled Inner Slot Antenna" U.S. patent No. 62/754,917. Both of the other innovations are now encapsulated within this array embodiment. The Wideband Compact Dual-Polarized Slot Antenna will be denoted as the 03 antenna. This antenna has been amply tested and measured by the Applicant, and a measured gain/radiation pattern also verifies a 5:1 operational bandwidth, with Broadside Absolute Gain above 0 dBi throughout. While this antenna can be scaled to almost any size, to fit within a leg of the 01 antenna, one embodiment shown has the overall diameter of this antenna to ⅔rds (⅘ths) the size of Antenna 02. Therefore, its lowest frequency of operation will be roughly $(3/2)*4*f_1=6*f_1$, or $f_6$. By choosing this dimension, this antenna begins its operation at exactly the same frequency, $f_6$, where the spacing of the 01 and 02 antennas will start to produce grating lobes. The power of the Antenna-within-Antenna technology now allows interleaving of smaller antennas, enabling denser antenna spacings, with very little negative impact in gain performance. As can be seen, the legs of the 01 antenna become the outer ground plane for the 03 antenna. It should be noted that the width of the 01 antenna is roughly 0.1λ, at the lowest frequency of operation, $f_1$. Therefore, as long as the outer diameter of the 03 antenna is less than this 0.1*λ, then both the 01 and the 03 antenna will operate efficiently. In fact, for operation starting at frequency $f_1$, the outer diameter of antenna 03 will be 0.3*λ*(⅙)=0.05λ, which is obviously less than 0.1λ. Note, the size and starting frequency for the 03 antenna can be changed, without loss of generality in this embodiment. For this particular embodiment, where the 03 antennas are exactly in between 02 antennas, in spacing, is denoted as Fill Pattern #1.

It is now possible to add another scaled version of the 01 antenna (similar to the 02 antenna), and position this (single layer, or metal) antenna above antenna 01. Denote this new antenna as antenna 01*a*. The feed line of this antenna (01*a*) would enter through the center of antenna 01. The ideal size for this antenna is of course related to the frequency, $f_5$, at which antenna 01 Absolute Broadside Gain is expected to decrease below +0 dBi, at $f_5$. Therefore, this antenna ideally would be 5 times smaller than antenna 01, and standoff of the antenna 01 by one-quarter wavelength of the $f_5$ frequency, or ⅕0th of λ1. At this size, antenna 01*a* would have negligible impact on antenna 01, or antenna 01 performance from $f_1$ to $f_5$. Use of this antenna (01*a*) is another embodiment of the general array concept. Implementation of antenna 01*a* now negates the full array as being strictly single layered, however, the relative depth of ⅕0th of λ1 would hardly create a size problem in most applications.

Figure 11:
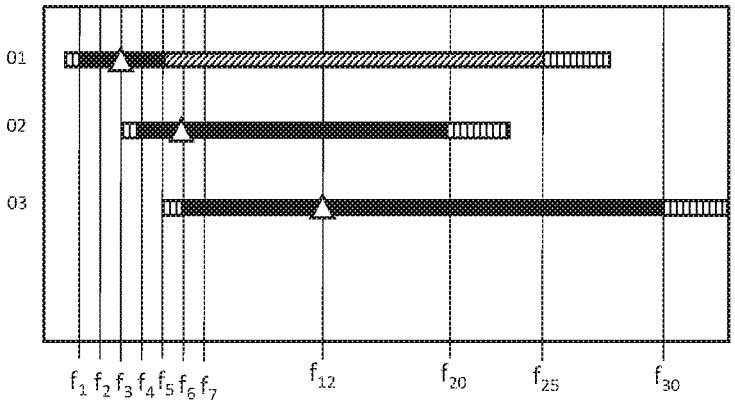
FIG. 11 shows the operational frequency range line chart for the subset array in FIG. 10.

FIG. 11 shows the operational frequency range line chart for the subset array in FIG. 10, that of two (or more) Dual Polarized Wideband Antennas (01), multiple scaled Dual Polarized Wideband Antennas (02), multiple Wideband Dual Polarized Slot Antennas (03) within the 01 antenna legs, and finally multiple 01*a* antennas at the phase center of antenna 01.

Again the solid black portions of the bars shows the operational frequency range, with Absolute Broadside Gain better than +0 dBi, and the white triangles shows the point as where grating lobes will start to occur, and grow, as frequencies increase. As can now be seen by the third (lowest) solid bar, antenna 03 enables operation with no grating lobes, through 12 times $f_1$, or $f_{12}$. However, full operation, with Absolution Broadside Gain above +0 dBi, extends all the way to 30 times $f_1$, or $f_{30}$. Note also, that use of the 01*a* antenna virtually extends the operation of antenna 01, to 25 times $f_1$, or $f_{25}$. Note, that since antenna 01*a* and antenna 01 both have the same (two dimensional) phase center, they can be treated as the same antenna.

At this point, we have an antenna and array system that can operate to a full 12:1 operational bandwidth with no natural grating lobes, to +/−45 degrees off array broadside, and to well over 25:1 using sidelobe and grating lobe suppression techniques, such as Taylor Windowing. Additionally, this solution has enormously fewer required RF ports, and therefore highly reduced (size and cost) RF and Digital back-end hardware than the TCDA technology.

Figure 12:
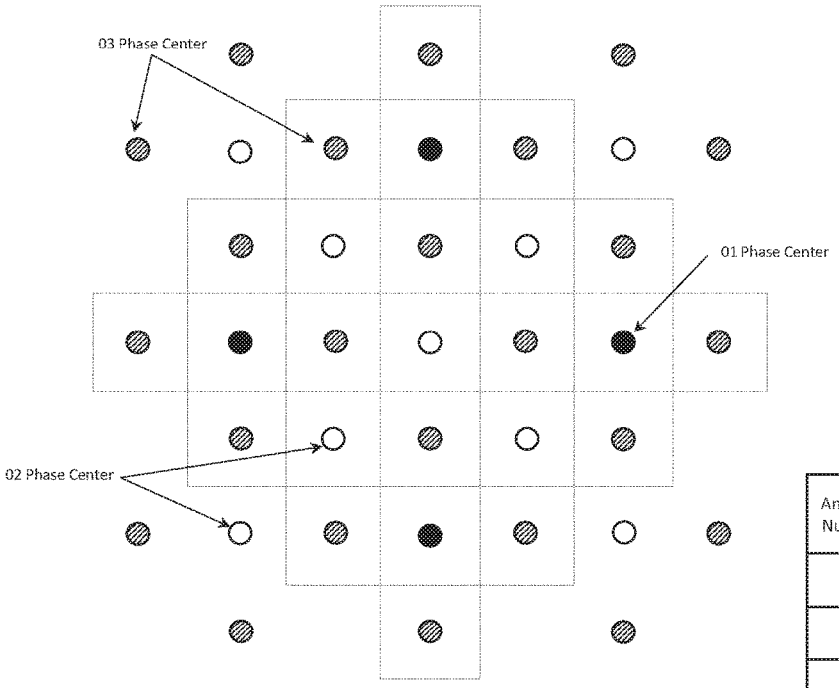
FIG. 12 shows the relative location of the phase centers for a 4-element array implementation of the 01 antennas, 9 of the 02 antennas, and 24 of the 03 antennas.

FIG. 12 shows the relative location of the phase centers for a 4-element array implementation of the 01 antennas, 9 of the 02 antennas, and 24 of the 03 antennas. It should be noted that the 03 antennas are interleaved exactly in between (half the distance) from the phase centers of the 01 and 02 antennas. This again represents a Radix-2 (power of 2) interleaving methodology. The legend on the top left shows the frequency coverage for each sub-array. The first sub-array is composed of 01 antennas, and therefore covers the frequency range of $f_1$ to $f_5$. The second sub-array is composed of 02 antennas, and covers the frequency range of 4 times $f_1$ to 20 times $f_1$ (or $f_4$ to $f_{20}$). The third sub-array is composed of 03 antennas, and covers the frequency range of 6 times $f_1$ to 30 times $f_1$ (or $f_6$ to $f_{30}$). It should be mentioned that this system still uses Fill Pattern #1, since higher frequency antennas are added in a Radix-2 fashion, e.g. half the distance away from neighboring antennas.

Figure 13:
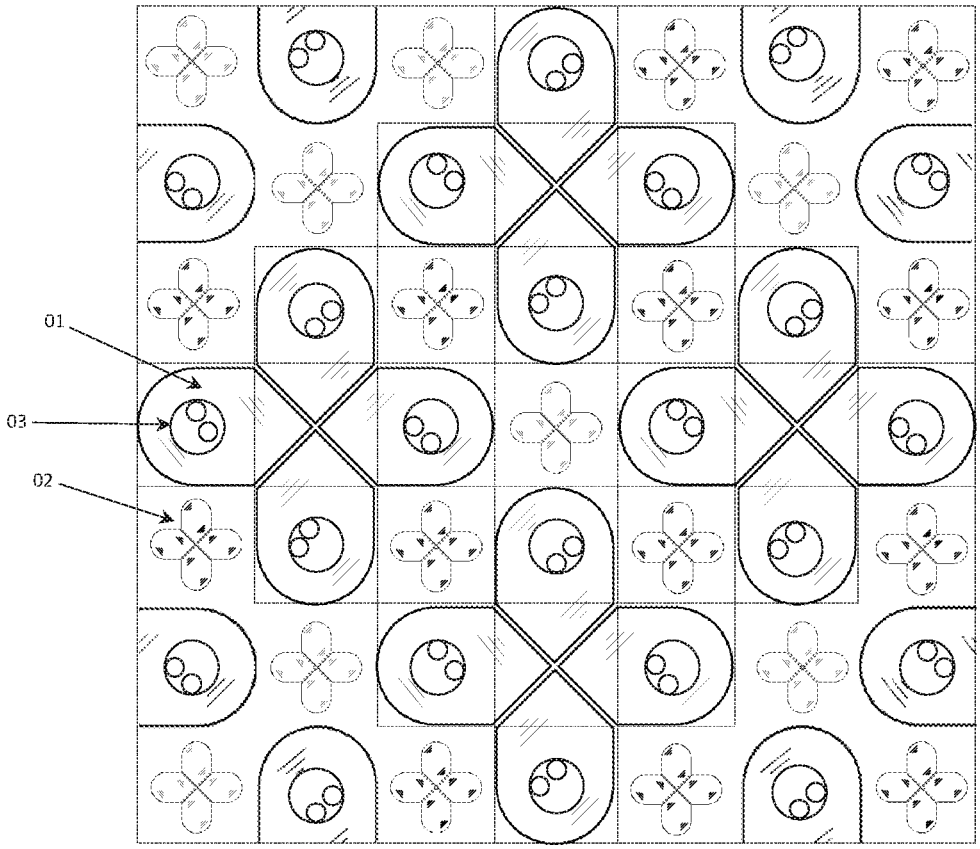
FIG. 13 shows a full implementation of the Dual Polarized Wideband Antenna array, including antenna elements 01, 02, and 03, for one embodiment of the array concept.

FIG. 13 shows a full implementation of the Dual Polarized Wideband Antenna array, including antenna elements 01, 02, and 03, for one embodiment of the array concept. This diagram in fact is actually showing a segment or cut-out of a dense array, including multiple partial arms of the 01 antennas on the borders. This diagram in fact is actually showing a segment or cut-out of a dense array. The cut-out, within this diagram, has 7×7 unit cells, with each unit cells of size 0.1λ×0.1λ. As can be seen, there are arm segments, of 01 antennas, from other full 01 antennas, not shown. This particular cut-out then has four full 01 antennas, 21 full 02 antennas, all interleaved, and finally 24 full 03 antenna within arms of multiple 01 antennas. With the addition of the 03 antennas, the phase center to phase center spacing between any two adjacent (neighboring) 01, 02, or 03 antennas is only 0.05 wavelengths, at the lowest frequency of operation, $f_1$. Therefore, for frequency of operation from $f_1$ to 12 times $f_1$ (denoted as $f_{12}$), this full array will have no (natural or unsuppressed) RF grating lobes, within a +/−45 degree window, in both azimuth as well as elevation. It should be mentioned that this system still uses Fill Pattern #1, since higher frequency antennas are added in a Radix-2 fashion, e.g. half the distance away from neighboring antennas.

Figure 14:
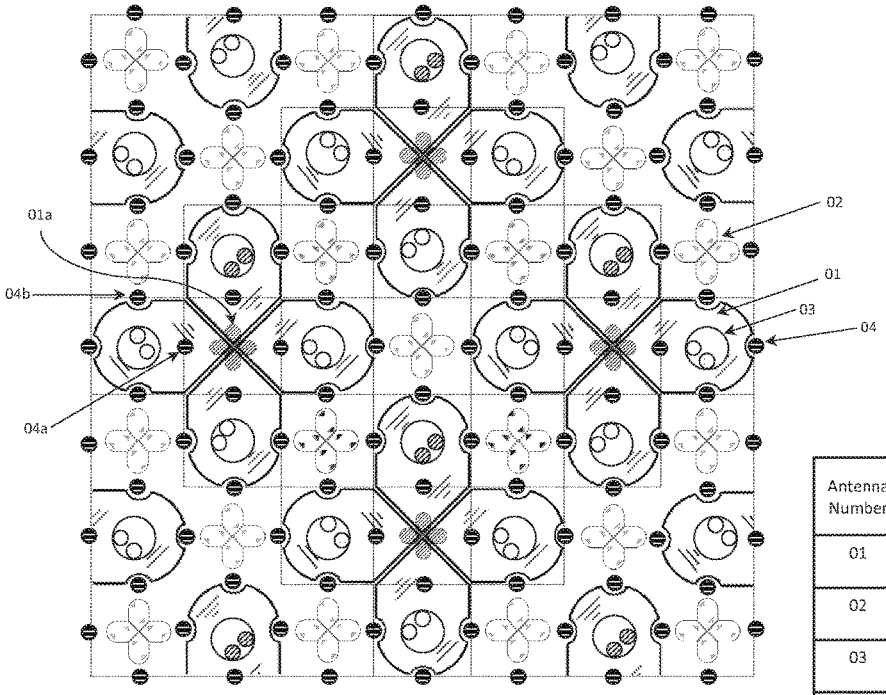
FIG. 14 shows the population solution for an additional sub-band of antennas that cover 12 times $f_1$ to 60 times $f_1$, or $f_{12}$ to $f_{60}$.

FIG. 14 shows the population solution for an additional sub-band of antennas that cover 12 times $f_1$ to 60 times $f_1$, or $f_{12}$ to $f_{60}$. When inside a 01 antenna (arm) the shaded dot ($12*f_1$ to $60*f_1$, or $f_{12}$ to $f_{60}$) will represent a Wideband Dual Polarized Slot antenna (04*a*). When outside the 01 antenna, the shaded dot will represent a scaled version of antenna 01 that is 04*b*. Notice that the 01 antenna edges have been modified to enable the inclusion of the 04*b* antennas, without physically touching the 01 antenna. Also note that this embodiment includes the 01*a* antenna. Another embodiment can be used that does not use the 01*a* antenna, and is thus completely single layer array. It should be mentioned that this system still uses Fill Pattern #1, since higher frequency antennas are added in a Radix-2 fashion, e.g. half the distance away from neighboring antennas.

Figure 15:
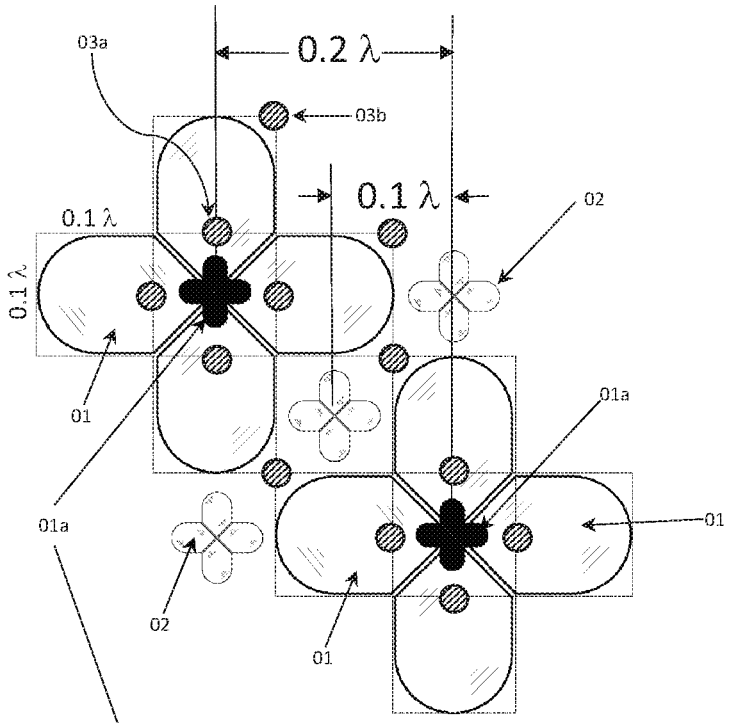
FIG. 15 illustrates another embodiment of the Antenna Array concept.

FIG. 15 represents another embodiment of the Antenna Array concept. In this embodiment, antenna 03 is split between an internal antenna (03*a*), which is the Wideband Dual Polarized (or single polarization) Dipole antenna and an external antenna (03*b*) which is a scaled (smaller) version of the Dual Polarized Wideband Dipole (01). Note also that the position of 03*a* is different from the position of 03, in Fill Pattern #1. Thus, this embodiment is denoted as Fill Pattern #2. Without loss of generality, it can be seen that any type of Wideband Slot antenna can be positioned almost anywhere inside antenna 01, where there is solid surface. Fill Pattern #2 is actually a diagonal Radix-2 approach, where additional antennas are positioned between other antenna on the diagonal line between these other antenna phase centers.

Figure 16:
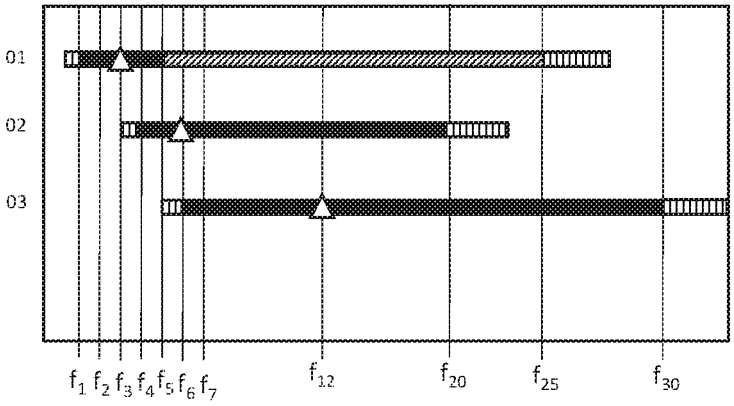
FIG. 16 shows the operational frequency range line chart for the subset array in FIG. 15, that of Fill Pattern #2.

FIG. 16 shows the operational frequency range line chart for the subset array in FIG. 15, that of Fill Pattern #2. Notice that this line chart is identical to that in FIG. 11.

Figure 17:
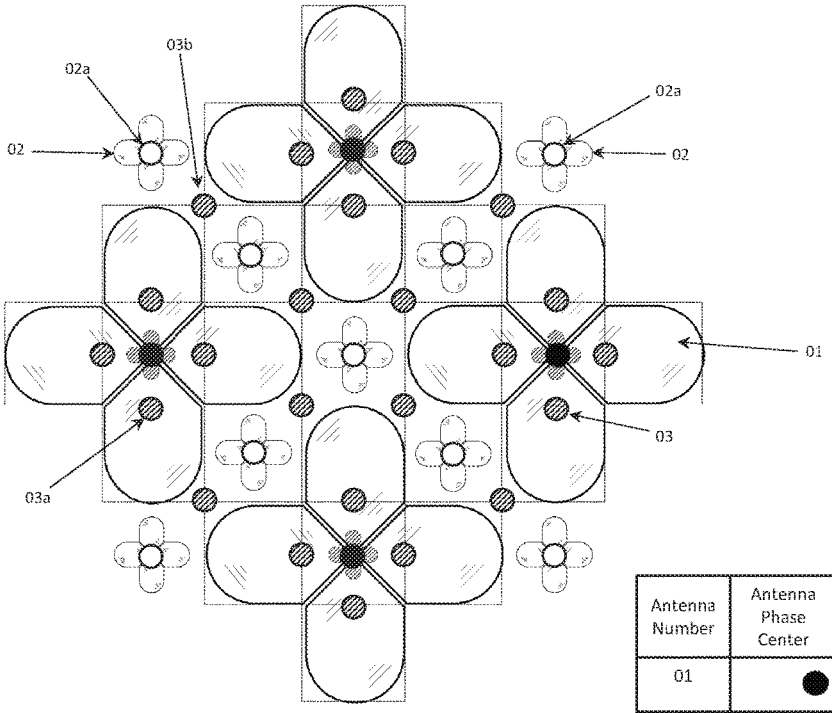
FIG. 17 shows four 01 elements and multiple 02, 03*a*, and 03*b* elements for Fill Pattern #2.

FIG. 17 shows four 01 elements and multiple 02, 03*a*, and 03*b* elements for Fill Pattern #2.

Figure 18:
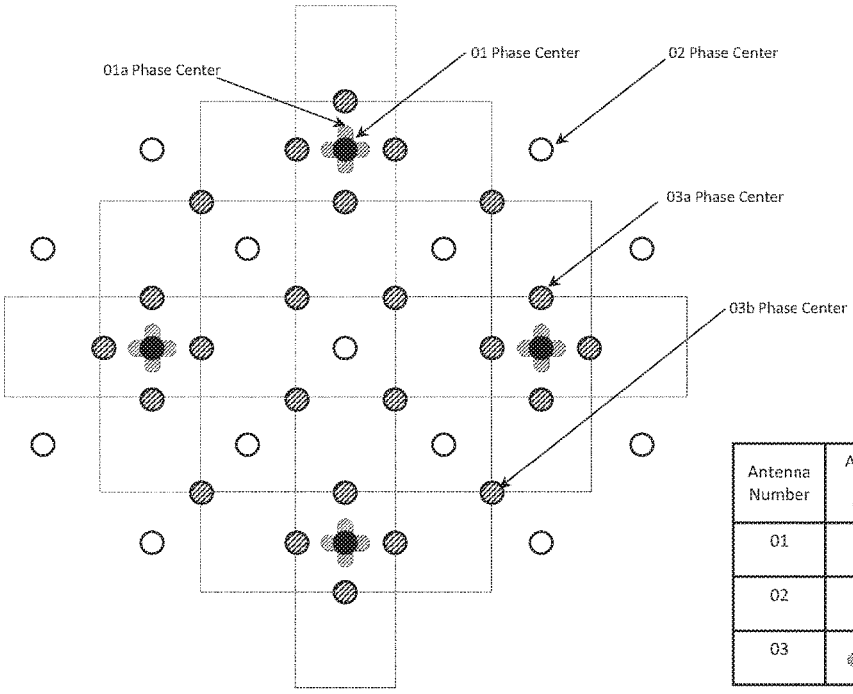
FIG. 18 shows the phase center locations for the Array of FIG. 17, Fill Pattern #2.

FIG. 18 shows the phase center locations for the Array of FIG. 17, Fill Pattern #2.

Figure 19:
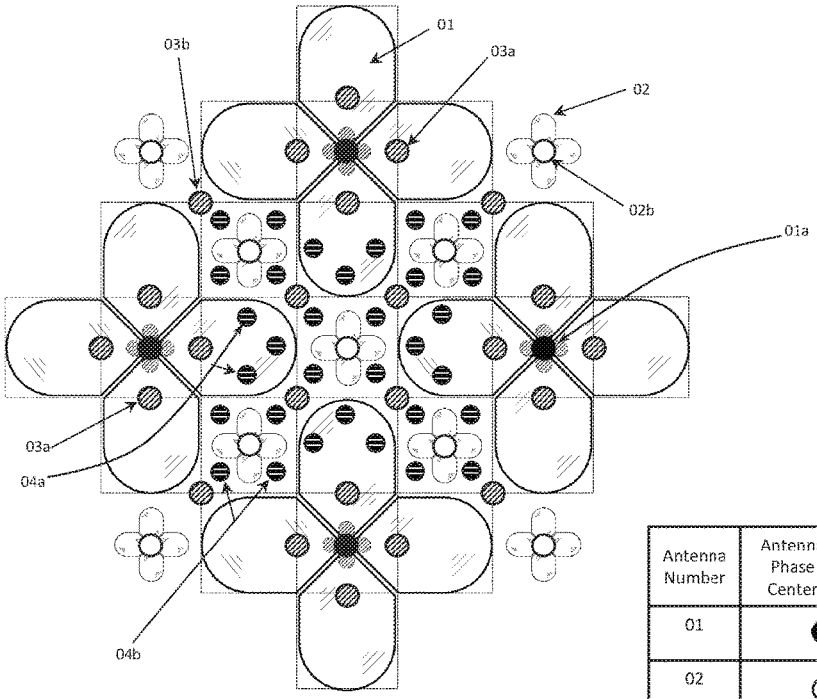
FIG. 19 shows the same array as for FIG. 17, for Fill Pattern #2, however with an added sub-array of higher frequency elements, covering $f_{12}$ to $f_{60}$.

FIG. 19 shows the same array as for FIG. 17, for Fill Pattern #2, however with an added sub-array of higher frequency elements, covering $f_{12}$ to $f_{60}$.

In this embodiment, antenna 04 is split between an internal antenna (04*a*), which is the Wideband Dual Polarized (or single polarization) Dipole antenna and an external antenna (04*b*) which is a scaled (smaller) version of the Dual Polarized Wideband Dipole (01). Note also that the positions of 04*a* and 04*b* are different from the position of 04, in Fill Pattern #1.

Figure 20:
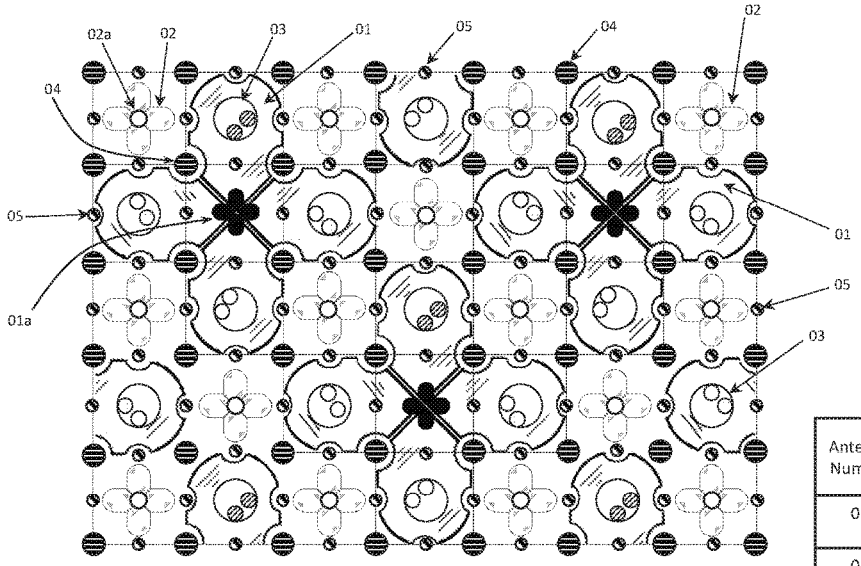
FIG. 20 presents yet another embodiment of the antenna array concept.

FIG. 20 shows yet another embodiment of the antenna array concept. In this embodiment, denoted as Fill Pattern #3, fully Radix-2 populated sub-band elements are used, and elements 02*a* is placed above element 02, similar to that of element 01*a* placed above element 01. Note that the size of 02*a* is again 5 times smaller than element 02. Thus, while element 02 operates from $f_4$ to $f_{20}$, element 02*a* operates from $f_{20}$ to $f_{100}$). Element 05, which is even smaller, operates from $f_{24}$ to $f_{120}$. Therefore, this array has operation from $f_1$ to well over $f_{100}$, thus with a 100:1 operational bandwidth.

Figure 21:
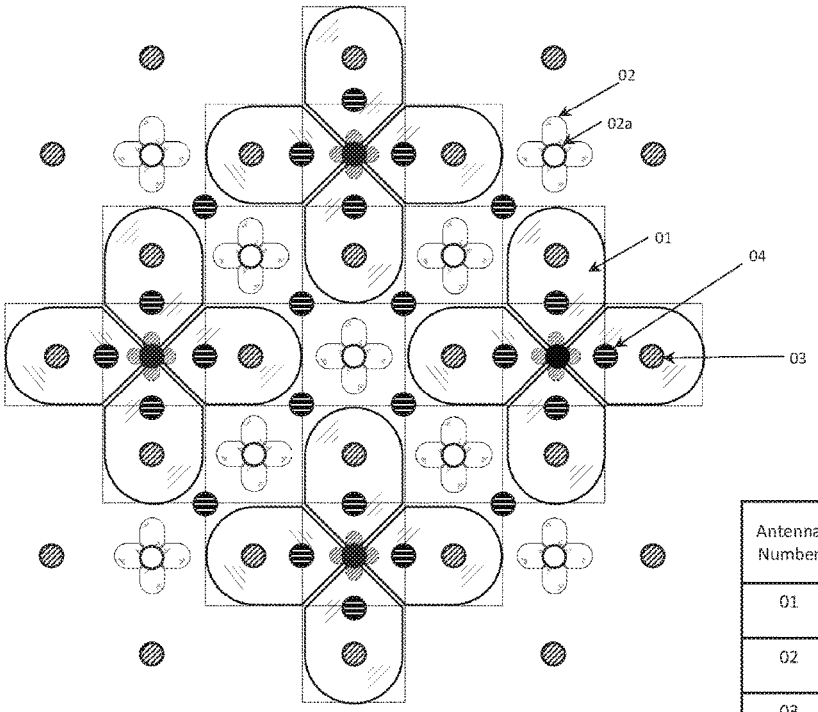
FIG. 21 shows yet another embodiment of the array, which is a combination of the Fill Pattern #1 and #2

FIG. 21 shows yet another embodiment of the array, which is a combination of the Fill Pattern #1 and #2.

There are infinite number of combinations, of the larger dual polarized wideband antenna 01, smaller scaled versions of the dual polarized wideband antenna 02, and compact wideband dual polarized slot antenna. These would also include antenna arrays using only single polarization versions of these antennas, or combinations of single polarization and dual polarization elements. The key factor is that all of these antennas are for the most part, single layer antennas, and that a very effective array can be composed on only single layer antenna elements, thus resulting in a single layer design. However, there are embodiments that include dual layers, such as the use of the 01*a* antenna, and other scaled versions of it.

Figure 22:
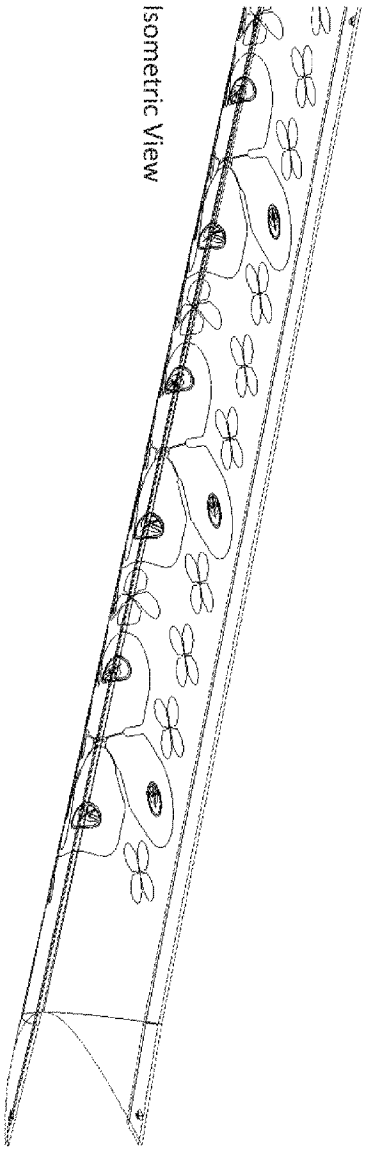
FIG. 22 shows an isometric view of the FIG. 13 embodiment of the array on a leading edge of an aircraft wing.
Figure 23:
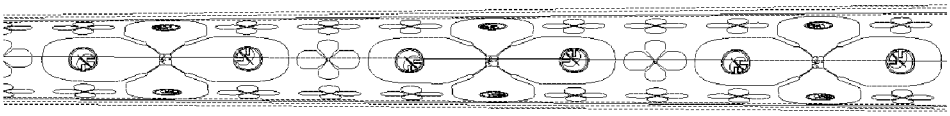
FIG. 23 shows the front view of the FIG. 13 embodiment of the array on a leading edge of an aircraft wing.
Figure 24:
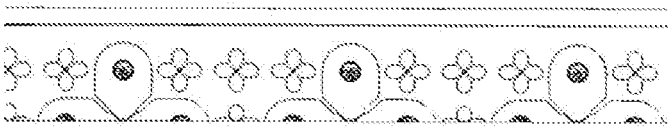
FIG. 24 shows the top view of the FIG. 13 embodiment of the array on a leading edge of an aircraft wing.

FIGS. 22, 23, and 24 show another embodiment of the array. In these figures, a subset of the array of FIG. 13 is contoured or wrapped on the leading edge of an aircraft wing. In doing so, the array is now fully conformal to the natural shape of the wing leading edge. Without a loss of generality, this conformal wrapping can be applied to literally all of the previous planar array geometries and figures. Additionally, this concept can be extended to wrapping of the array onto aircraft fuselage, other aircraft surfaces, as well as to the surface of an automobile or boat (or ship).

REFERENCES (INCORPORATED HEREIN BY REFERENCE)

M. Judd, "Dual Polarization Antenna," U.S. patent No. 10,389,015.

M. Judd, "Compact Wideband Slot Antenna with Inverted Co-Planar Waveguide," U.S. patent application Ser. No. 16/582,061.

M. Judd, "Decoupled Inner Slot Antenna," U.S. patent application Ser. No. 16/663,650.

What is claimed is:

1. An antenna array comprising:

a Wideband Dual Polarized antenna, denoted as the largest or first antenna type, consisting of two orthogonal Wideband antennas, each polarized subset wideband antenna characterized by two opposite dipole legs, and designated as the (01) antenna element;

a second antenna type, (02), which is simply a one-quarter scaled size version of the first antenna, in every dimension;

a Wideband Compact Slot Antenna, denoted as the third (03) antenna type, and the use as Antennas-within-Antennas;

wherein the legs of the (01) antenna become the outer ground plane for the (03) antenna; and wherein the total of all components, consisting of all three antenna types, are conformal to a single surface.

2. The array of claim 1 wherein the largest antenna in the array is either a dual polarized wideband cross dipole, or a single polarization wideband dipole, with a wideband dual polarized slot antenna within each leg.

3. The array of claim 1, wherein the largest antennas, with dimensions of roughly 0.3 wavelengths by 0.3 wavelengths at the lower frequency of operation, are positioned roughly 0.4 wavelengths at the lowest operating frequency, away from the next largest antenna; in a linear array, or roughly 0.4 wavelengths at the lowest operating frequency, in both the x-axis and y-axis in a rectangular fashion; for a two-dimensional array.

4. The array of claim 1, wherein the smaller (02) antenna, which is also a dual polarized cross dipole antenna that is a roughly a one-quarter scaled size version of the first larger antenna, is arranged in a lattice structure of a multiplicity of antennas around the first, larger, (01) antenna.

5. The array of claim 1, wherein both the second, (02), dual polarized cross dipole antenna and the third, 03, dual polarized wideband slot antenna, are arranged in a rectangular radix-2 fashion, wherein each smaller antenna is spaced half the distance of the next larger antenna, in both the x-axis as well as the y-axis, which represents a radix-2, power of 2, interleaving methodology.

6. The array of claim 1 wherein the third (03) dual polarized wideband slot antenna is located inside the legs of the first (03) antenna.

7. The array of claim 1 wherein the whole array system has the following characteristics:

(a) 25:1 to 100:1 ratio operational frequency range
(b) Reduced number of RF ports, compared to Tightly Coupled Dipole Antenna, TCDA, arrays by 10× to 25× times
(c) Can be implemented on a flat or conformal surface
(d) operational on a single layer of metal
(e) operational on curved surfaces, like aircraft wing leading edges
(f) With nearly infinite operational frequency (array operating bandwidth)
(g) No Grating Lobes at any frequency, within the operational array bandwidth
(h) The ability to transmit or receive dual or diversely polarized signals, at any frequency within the operational bandwidth
(i) Simple to construct, with low fabrication costs, this would include single or dual layer antennas
(j) The back-end easily plumbs to existing or almost-COTS RF and Digital hardware, including the most minimal number of RF ports, per unit frequency
(k) Minimum Scan Volume of +/−45 degrees, in both azimuth and elevation.

8. The array of claim 1 wherein the antennas within antennas of the array, enable not only higher compactness of the array, but as the array operating frequency increases, the antennas between already activated antennas can be activated to achieve lower antenna-to-antenna spacing distances and to avoid the generation of grating lobes.

9. A method of constructing an antenna array comprising:

a Wideband Dual Polarized antenna, denoted as the largest or first antenna type, consisting of two orthogonal Wideband antennas, each polarized subset wideband antenna characterized by two opposite dipole legs, and designated as the (01) antenna element;

a second antenna type, (02), which is simply a one-quarter scaled size version of the first antenna, in every dimension;

a Wideband Compact Slot Antenna, denoted as the third (03) antenna type, and the use as Antennas-within-Antennas;

wherein the legs of the (01) antenna become the outer ground plane for the (03) antenna; and wherein the total of all components, consisting of all three antenna types, are conformal to a single surface.

10. The method of claim 9 wherein the largest antenna in the array is either a dual polarized wideband cross dipole, or a single polarization wideband dipole, with a wideband dual polarized slot antenna within each leg.

11. The method of claim 9 wherein the largest antennas, with dimensions of roughly 0.3 wavelengths by 0.3 wavelengths at the lower frequency of operation, are positioned roughly 0.4 wavelengths at the lowest operating frequency, away from the next largest antenna; in a linear array, or roughly 0.4 wavelengths at the lowest operating frequency, in both the x-axis and y-axis in a rectangular fashion; for a two-dimensional array.

12. The method of claim 9 wherein the smaller (02) antenna, which is also a dual polarized cross dipole antenna that is a roughly a one-quarter scaled size version of the first larger antenna, is arranged in a lattice structure of a multiplicity of antennas around the first, larger, (01) antenna.

13. The method of claim 9, wherein both the second, (02), dual polarized cross dipole antenna and the third, (03), dual polarized wideband slot antenna, are arranged in a rectangular radix-2 fashion, wherein each smaller antenna is spaced half the distance of the next larger antenna, in both the x-axis as well as the y-axis, which represents a radix-2, power of 2, interleaving methodology.

14. The method of claim 9 wherein the third (03) dual polarized wideband slot antenna is located inside the legs of the first (01) antenna.

15. The method of claim 9 wherein the whole array system has the following characteristics:

(a) 25:1 to 100:1 ratio operational frequency range
(b) Reduced number of RF ports, compared to Tightly Coupled Dipole Antenna, TCDA, arrays by 10× to 25× times
(c) Can be implemented on a flat or conformal surface
(d) operational on a single layer of metal
(e) operational on curved surfaces, like aircraft wing leading edges
(f) With nearly infinite operational frequency (array operating bandwidth)
(g) No Grating Lobes at any frequency, within the operational array bandwidth
(h) The ability to transmit or receive dual or diversely polarized signals, at any frequency within the operational bandwidth
(i) Simple to construct, with low fabrication costs, this would include single or dual layer antennas
(j) The back-end easily plumbs to existing or almost-COTS RF and Digital hardware, including the most minimal number of RF ports, per unit frequency
(k) Minimum Scan Volume of +/−45 degrees, in both azimuth and elevation.

16. The method of claim 9 wherein the antennas within antennas of the array, enable not only higher compactness of the array, but as the array operating frequency increases, the antennas between already activated antennas can be activated to achieve lower antenna-to-antenna spacing distances and to avoid the generation of grating lobes.

* * * * *